United States Patent [19]

Kobayashi et al.

[11] 4,142,492

[45] Mar. 6, 1979

[54] EXHAUST GAS PURIFICATION SYSTEM

[75] Inventors: Kazuo Kobayashi; Katsuhiko Yokooku; Kazumasa Nomura, all of Hiroshima, Japan

[73] Assignee: Toyo Kogyo Co., Ltd., Hiroshima, Japan

[21] Appl. No.: 836,901

[22] Filed: Sep. 26, 1977

[30] Foreign Application Priority Data

Oct. 4, 1976 [JP] Japan ..... 51-133838[U]
Oct. 4, 1976 [JP] Japan ..... 51-133839[U]

[51] Int. Cl.[2] ..... F02M 25/06

[52] U.S. Cl. ..... 123/119 A; 60/278; 60/279

[58] Field of Search ..... 123/119 A; 60/304, 305, 60/, 306, 278, 279

[56] References Cited

U.S. PATENT DOCUMENTS

| | | | |
|---|---|---|---|
| 3,776,207 | 12/1973 | Simko | 123/119 A |
| 3,779,013 | 12/1973 | Faber et al. | 123/119 A |
| 3,796,049 | 3/1974 | Hayashi | 123/119 A |
| 3,885,540 | 5/1975 | Stadler | 123/119 A |
| 3,929,118 | 12/1975 | Leong | 123/119 A |
| 4,068,628 | 1/1978 | Duckworth | 123/119 A |
| 4,084,372 | 4/1978 | Kuroda et al. | 123/119 A |
| 4,091,615 | 5/1978 | Hayashi et al. | 123/119 A |

*Primary Examiner*—Wendell E. Burns
*Attorney, Agent, or Firm*—Wenderoth, Lind & Ponack

[57] ABSTRACT

An exhaust gas purification system for use in an internal combustion engine equipped with a dual exhaust system. The exhaust gas purification system includes a secondary air supplying port of a secondary air supplying passage opened into selected one of a first or second group of exhaust pipes, while an exhaust gas deriving port of an exhaust gas recycling passage for recycling the exhaust gases to an upstream of the carburetor throttle valve is provided in the exhaust line at a downstream from the above secondary air supplying port for effective suppression of NOx through accurate control of the amount of exhaust gases to be recycled.

11 Claims, 14 Drawing Figures

EXHAUST GAS PURIFICATION SYSTEM

Figure 1:
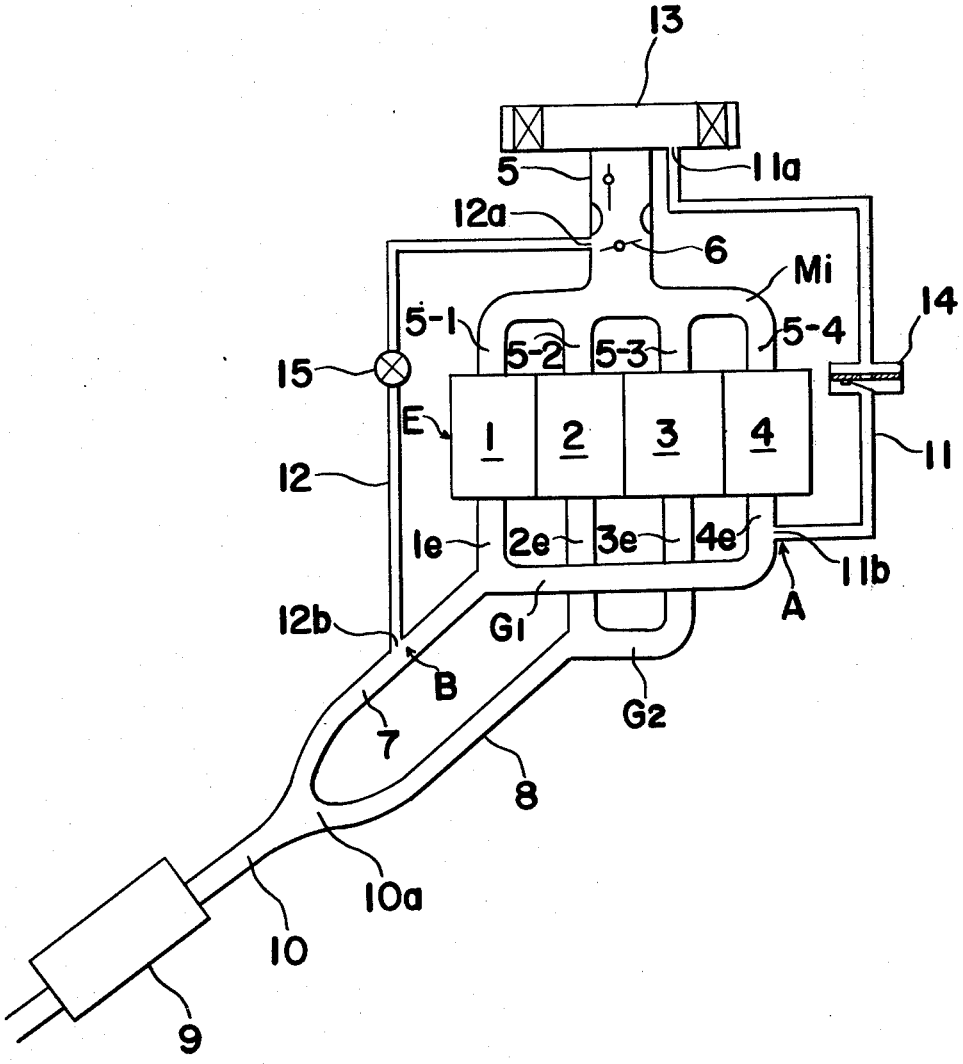

The present invention relates to an exhaust gas purification system and more particularly, to a combination of an exhaust gas recycling means and secondary air supplying means or arrangements thereof for a dual exhaust system in an internal combustion engine equipped with such a dual exhaust system.

Conventionally, for the purification of exhaust gases containing unburned noxious compounds such as nitrous oxides, carbon monoxide, hydrocarbons, etc., there has been known a technical concept in which formation especially of nitrogen oxides or NOx is suppressed through reduction of the highest combustion temperature of an air-fuel mixture by recycling a portion of exhaust gases discharged from an engine to the air-fuel mixture to be introduced into the engine (i.e., the so-called EGR (Exhaust gas recycling) system), with simultaneous introduction of a secondary air into the exhaust system for suppressing the unburned noxious compounds such as CO, HC and the like in the exhaust gases to a minimum amount.

Although the exhaust gas recycling means for the exhaust gas purification system of the above described type, especially the exhaust gas recycling arrangement in which the exhaust gases are recycled to an air-fuel intake passage at an upstream of a carburetor throttle valve is a very effective means from the viewpoint of the NOx suppression, there have been various problems inherent in it such as reduction of engine output following the recycling of the exhaust gases, difficulty for accurately controlling the recycling of the exhaust gases due to changeability of exhaust gas recycling amount by the influence of exhaust pulsation and especially adverse effect produced between the recycling means and the secondary air supplying means when the latter is simultaneously employed.

One type of such a known arrangement is disclosed, for exmple, in U.S. Pat. No. 3,643,640, issued Feb. 22, 1972 in which the secondary air is introduced into the exhaust system of the internal combustion engine which is not equipped with the dual exhaust system, while the exhaust system is connected to the intake passage at the upstream of the throttle valve for recycling the exhaust gases to the latter. In this prior art, the secondary air is supplied to all of the exhaust pipes, with the exhaust gases recycled from the exhaust system at the downstream therefrom. The known arrangement as described above, however, has such disadvantages that since the engine is not provided with the dual exhaust system, there are still various problems related to interference of exhaust gases between the exhaust pipes, undesirable reduction of the engine output, etc.

Meanwhile, as an exhaust system of an engine, there has been known the dual exhaust system in which exhaust pipes of cylinders whose ignition sequences are not continuous are classified into two groups for collecting the exhaust pipes in each of the groups into first and second connecting pipes respectively, while the first and second connecting pipes are further collected into an exhaust line opened at its one end into the atmosphere. The dual exhaust system as described above has such advantages that the engine output performance is improved with a higher scavenging efficiency for exhaust gases through prevention of interference between the exhaust pipes, and that owing to the increased exhaust pulsation in the groups of exhaust pipes, the system is particularly effective when the so-called spontanous suction type secondary air supplying means is employed for introducing the secondary air into the exhaust system through utilization of the exhaust pulsation.

Accordingly, an essential object of the present invention is to provide an exhaust gas purification system for use in an internal combustion engine equipped with a dual exhaust system in which, with effective utilization of the exhaust characteristics of the dual exhaust system, a secondary air supplying means and an exhaust gas recycling means particularly adapted to recycle exhaust gases to an intake passage at an upstream of the carburetor throttle valve are properly arranged so that the exhaust gases required for drastic suppression of NOx over the entire range of the engine operation are positively recycled to the engine intake system.

Another important object of the present invention is to provide an exhaust gas purification system of the above described type in which a position for deriving the exhaust gases for recycling the exhaust gas to an intake passage at an upstream of the carburetor throttle valve, is properly set in an exhaust system at the downstream from the secondary air supplying port.

A further object of the present invention is to provide an exhaust gas purification system of the above described type which is simple in construction and accurate in functioning, and can be readily incorporated into the internal combustion engines of the kind at low cost.

In accomplishing these and other objects according to one preferred embodiment of the present invention, in an internal combustion engine equipped with a dual exhaust system, a supplying port for a secondary air is opened in selected one of first and second groups of exhaust pipes, while, in an exhaust system at the downstream from said secondary air supplying port, there is provided an exhaust gas deriving port for recycling the exhaust gases to an intake passage at an upstream of the carburetor throttle valve, by which arrangement, it has become possible to achieve an exhaust gas recycling ratio of high level, through introduction of necessary secondary air, with the engine output being maintained by the dual exhaust system, while the exhaust gases are adapted to be recycled to the upstream of the carburetor throttle valve without being influenced by the exhaust pulsation through absorption of shock of the exhaust pulsation by the introduction of the secondary air, thus effective suppression of NOx being achieved through accurate control of the amount of the recycled exhaust gases.

Figure 2:
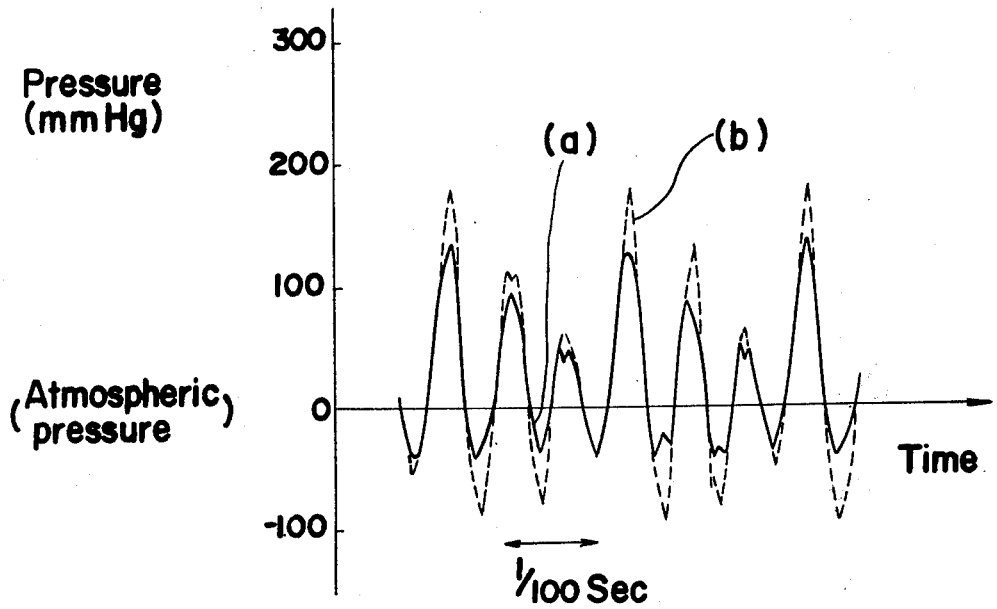
Figure 3:
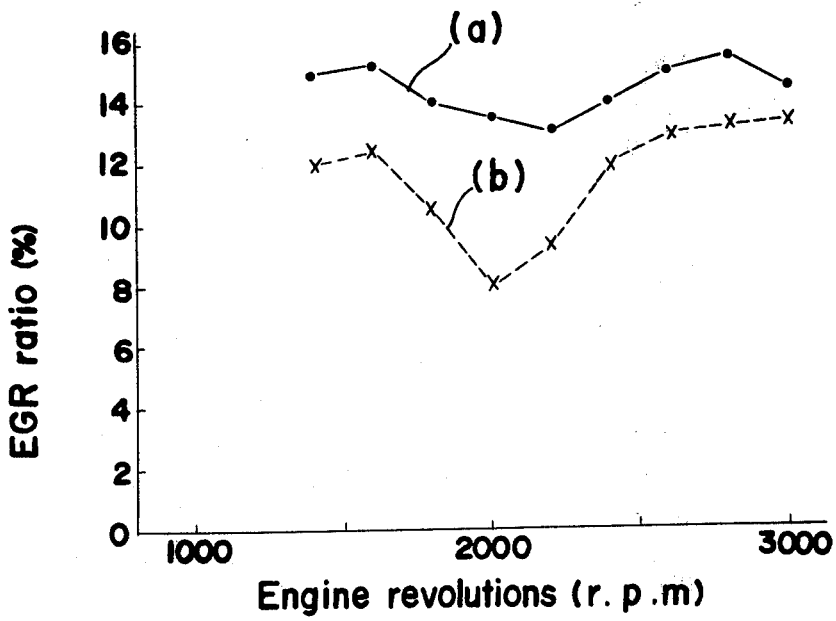
Figure 4:
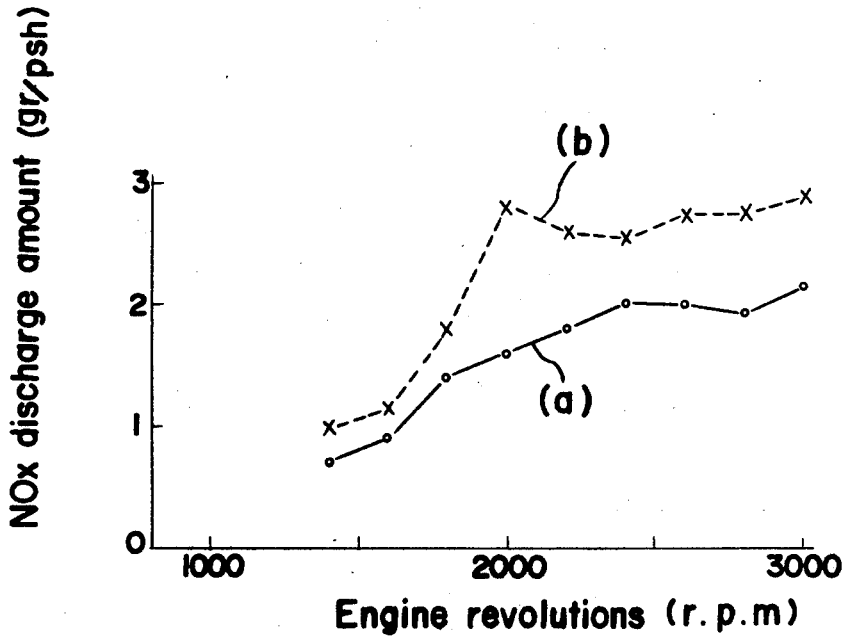
Figure 5:
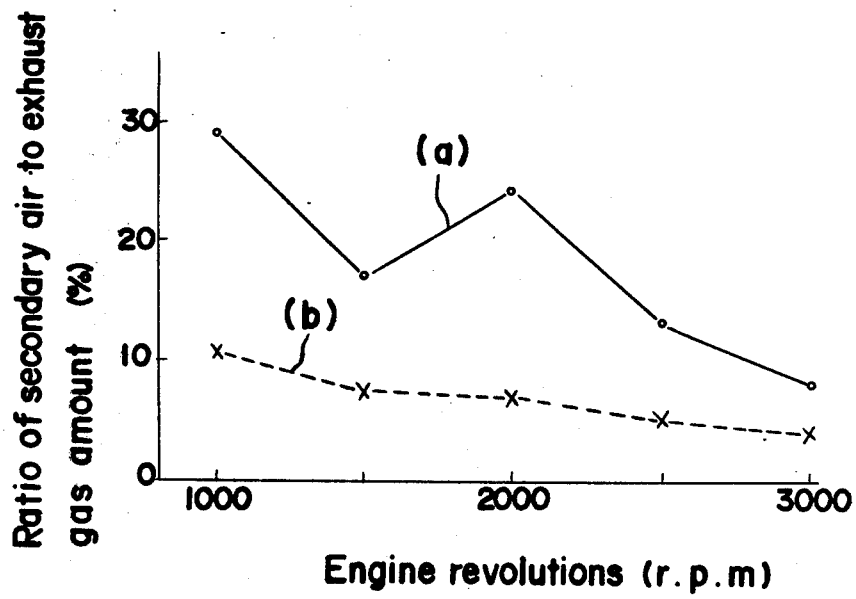
Figure 6:
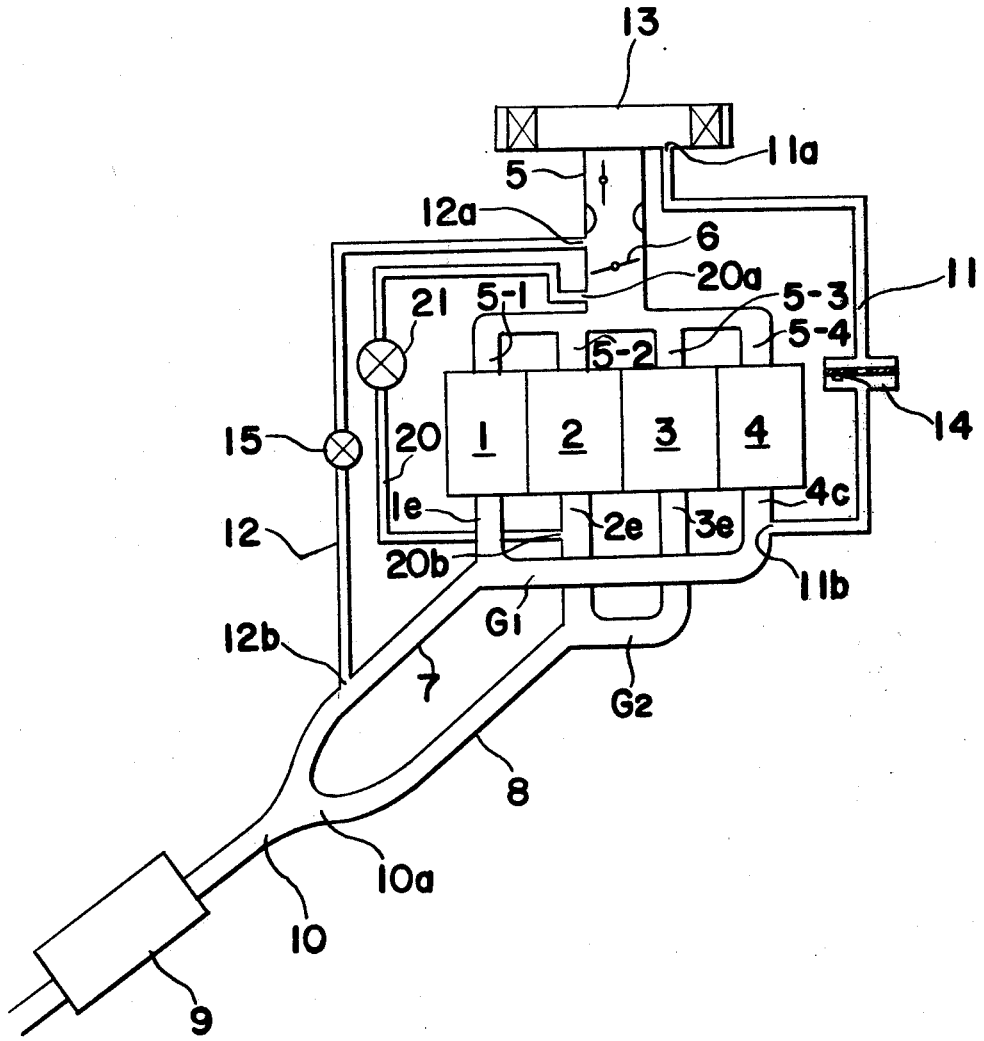
Figure 7:
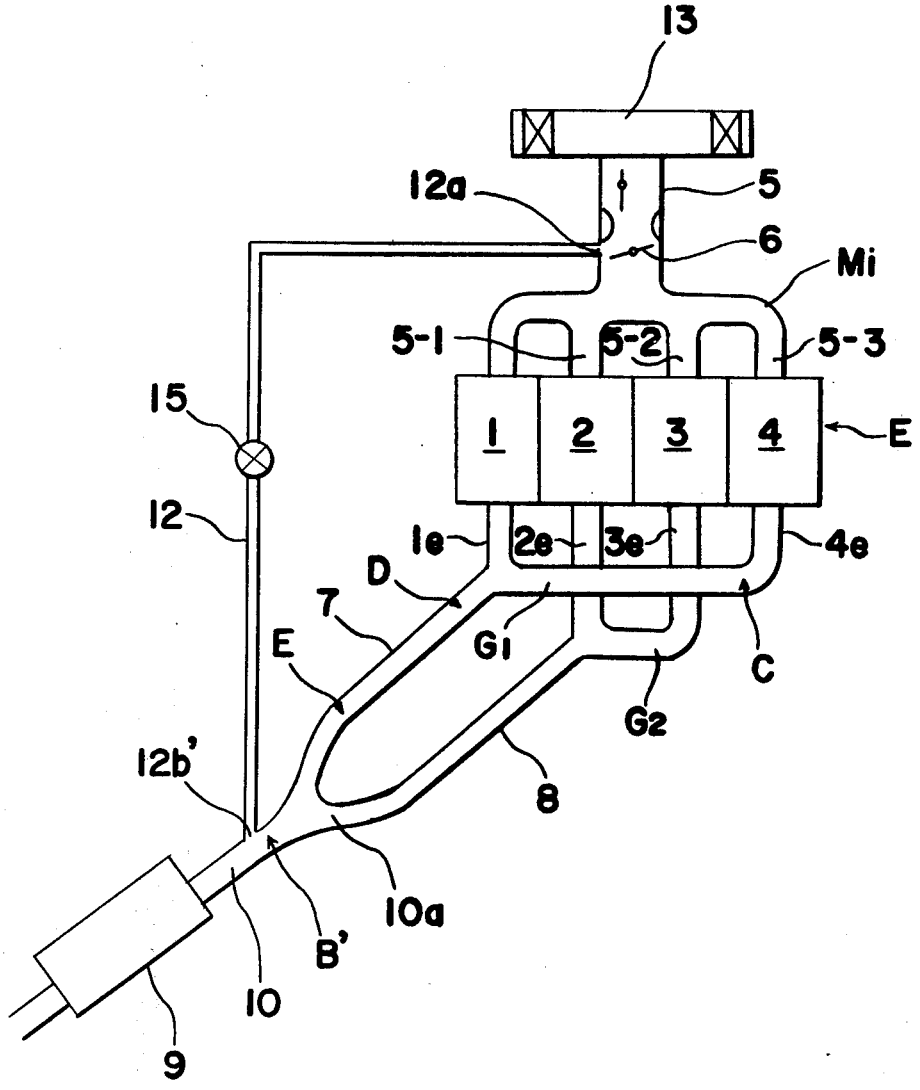
Figure 8:
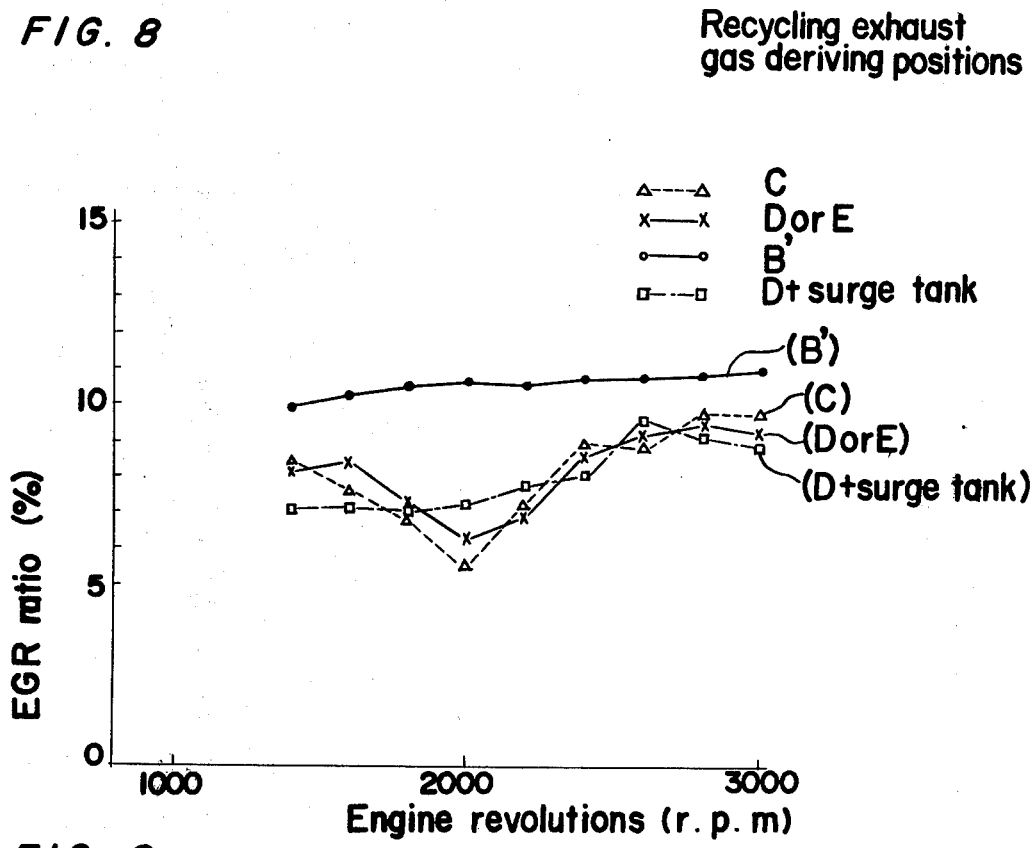
Figure 9:
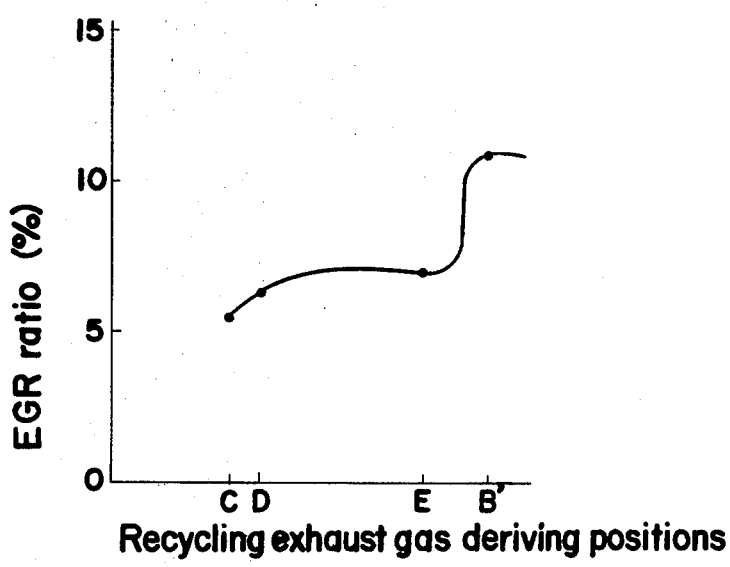
Figure 10:
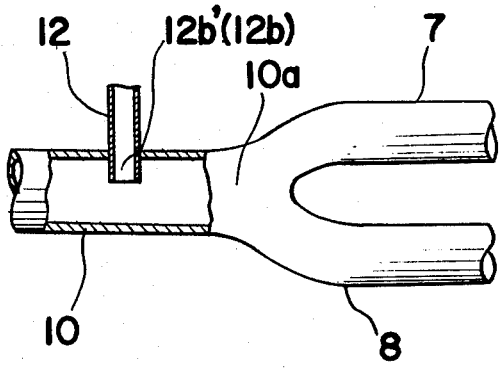
Figure 11:
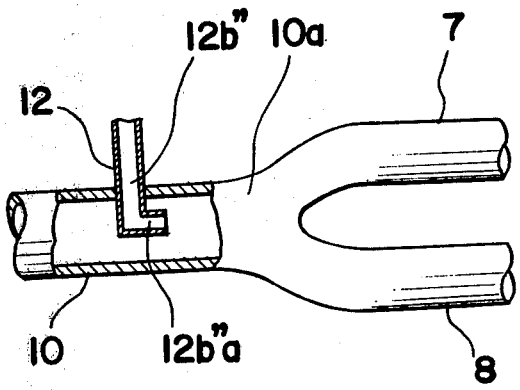
Figure 12:
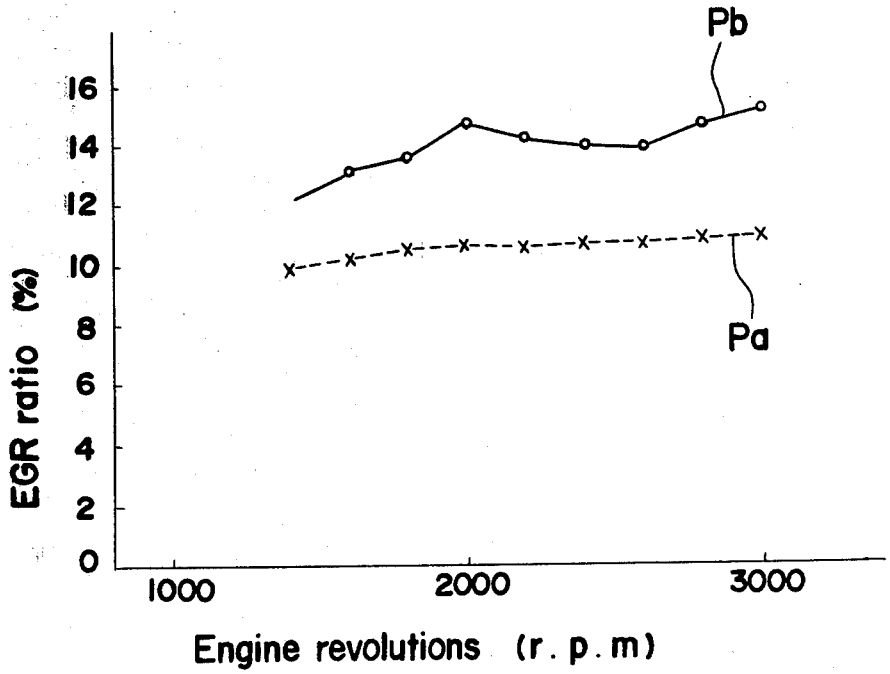
Figure 13:
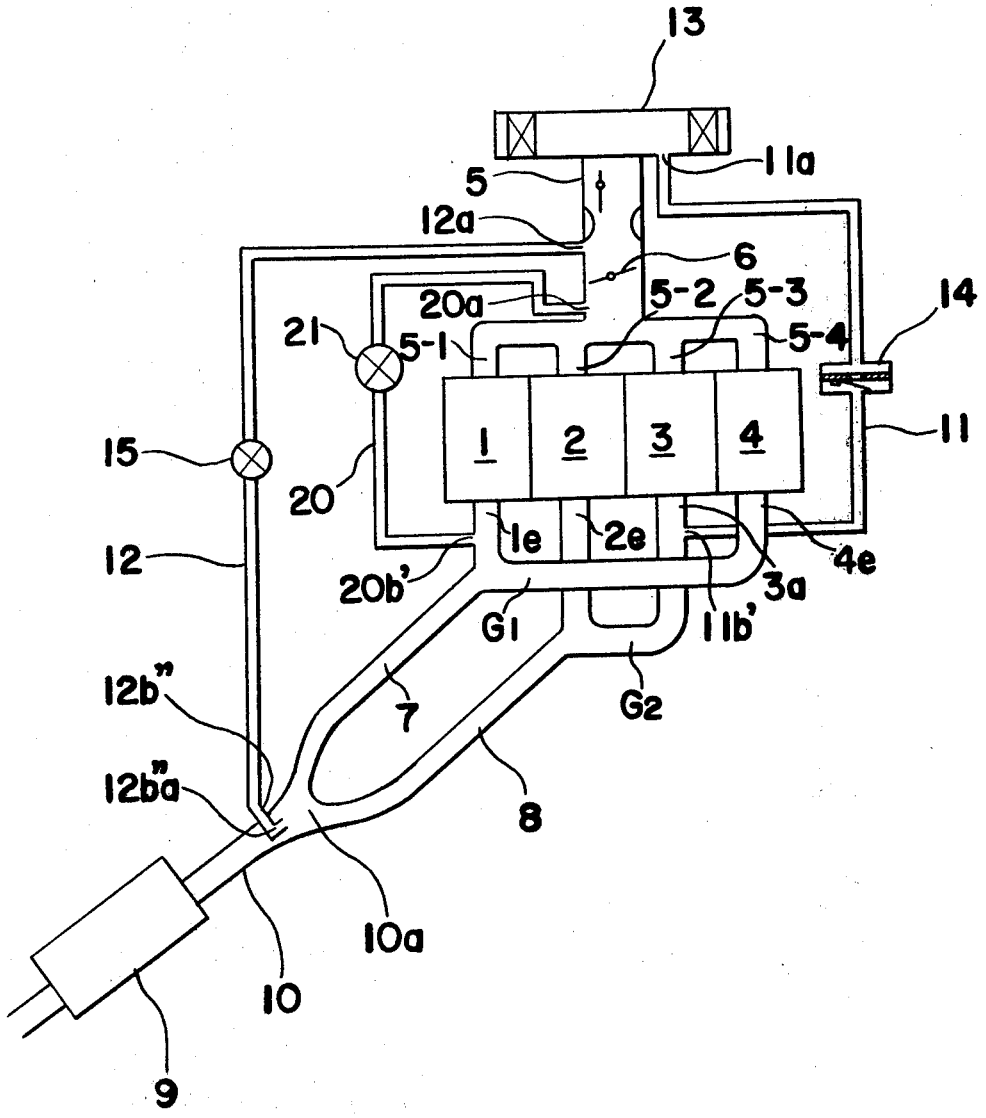
Figure 14:
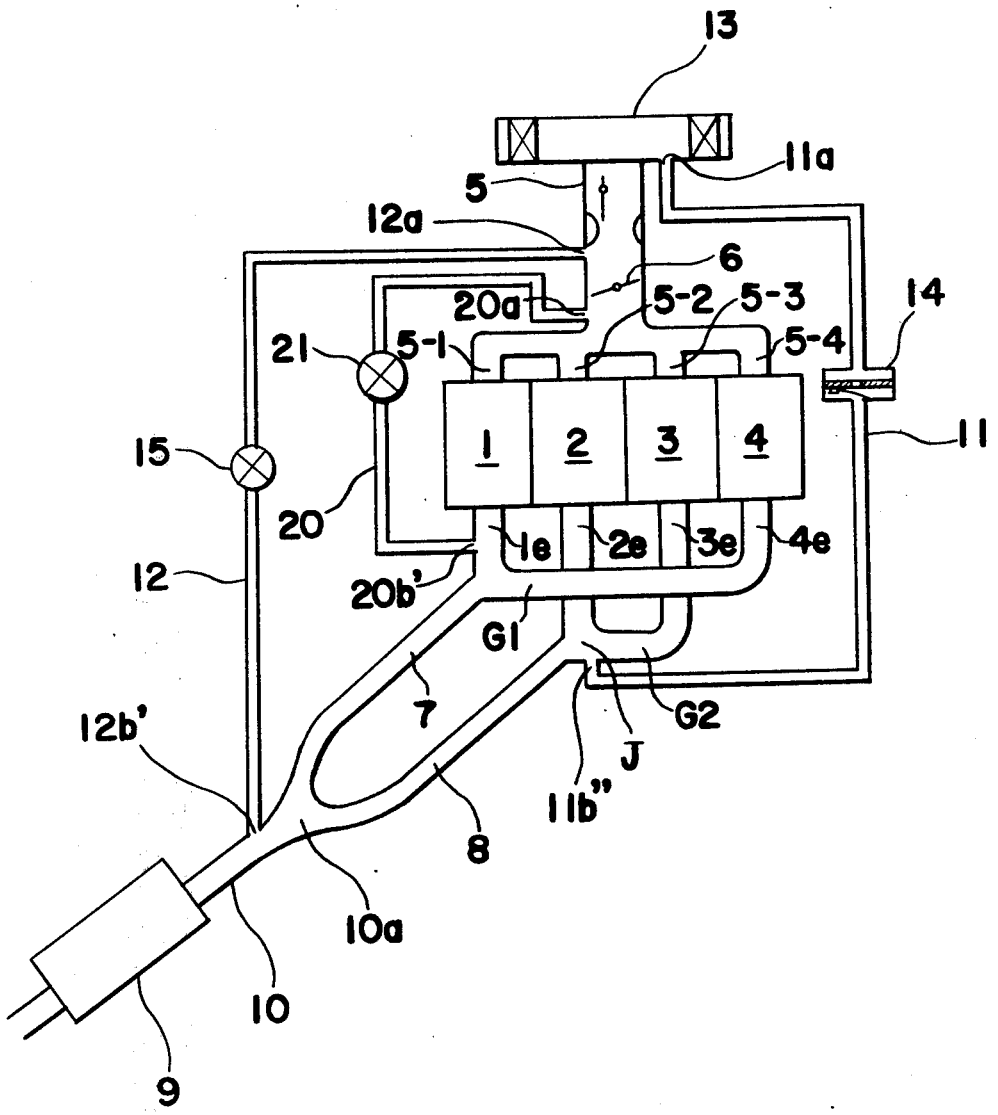

These and other objects and features of the present invention will become apparent from the following description taken in conjunction with the preferred embodiment thereof with reference to the accompanying drawings in which;

FIG. 1 is a schematic diagram showing a construction of a four-cylinder internal combustion engine to which an exhaust gas purification system of the present invention is applied, FIG. 2 is a graph showing state of exhaust pulsation at particular positions of the diagram of FIG. 1, FIG. 3 is a graph showing relation between engine revolutions and exhaust recycling ratio corresponding to set positions of a secondary air supplying port and exhaust gase deriving port, FIG. 4 is a graph showing relation between engine revolutions and amount of NOx discharge, FIG. 5 is a graph showing relation between engine revolutions and ratio of exhaust gas amount to the secondary air supplied, FIGS. 6 and 7 are similar views to FIG. 1, but particularly show modifications thereof, FIG. 8 is a graph showing relation of variations of the exhaust gas recycling ratio according to positions of the exhaust gas deriving port with respect to the engine revolutions, FIG. 9 is a graph showing relation between positions for the exhaust gas deriving and exhaust gas recycling ratio under constant engine revolutions, FIG. 10 is a fragmentary view, partly in section, showing on an enlarged scale, construction of the exhaust gas deriving port employed in the arrangements of FIGS. 1, 6 and 7, FIG. 11 is a similar view to FIG. 10, but particularly shows a modification thereof, FIG. 12 is a graph showing relation of variations of the exhaust gas recycling ratio according to configurations of the exhaust gas deriving port with respect to the engine revolutions, and FIGS. 13 and 14 are similar views to FIG. 1, but particularly show further modifications thereof, Before the description of the present invention proceeds, it is to be noted that like parts are designated by like reference numerals throughout several views of the accompanying drawings.

Referring now to the drawings, there is shown in FIG. 1 a four-cylinder internal combustion engine E in which an air-fuel mixture introduced through an air filter or air cleaner 13 is supplied into each of cylinders 1, 2, 3 and 4 through a common intake line or intake passage 5 and via passages 5-1, 5-2, 5-3 and 5-4 of an intake manifold Mi branched at a downstream of a carburetor throttle valve 6. It is to be noted here that in the four-cylinder engine of the above described type, ignition normally takes place, for example, in the order of the cylinders 1, 3, 4 and 2. Meanwhile, exhaust pipes 1*e*, 2*e*, 3*e*, and 4*e* for the respective cylinders 1 to 4 are classified into first and second groups G1 and G2, in each of which the exhaust pipes whose ignition sequences are not continuous, for example, the exhaust pipes 1*e* and 4*e*, and 2*e* and 3*e* are combined, and the exhaust pipes 1*e* and 4*e* belonging to the first exhaust pipe group G1 and the exhaust pipes 2*e* and 3*e* belonging to the second exhaust pipe group G2 are once collected into a first connecting pipe 7 and a second connecting pipe 8 respectively, while the first and second connecting pipes 7 and 8 are further collected at a junction 10*a* thereof into a lead-out pipe 10 leading to the atmosphere so as to form the so-called dual exhaust system on the whole. A catalysis type purification device 9 is provided in the lead-out pipe 10.

In the present invention in which the exhaust characteristics of the dual exhaust system as described above are taken into account, there is provided a secondary air supplying port 11*b* of a secondary air supplying passage 11 in the exhaust pipe which belongs to either one of the first exhaust pipe group G1 or second exhaust pipe group G2, for example, at an intermediate position A of the exhaust pipe 4*e* of the first group G1, while, in the exhaust system at a downstream of the position A for the supplying port 11*b*, for example, at an intermediate position B of the first connecting pipe 7, an upstream exhaust gas deriving port 12*b* for an exhaust gas recycling passage 12 is provided, with an exhaust gas recycling port 12*a* of said recycling passage 12 being opened into the intake passage 5 upstream of the carburetor throttle valve 6. It is advantageous to provide an air intake port 11*a* for the secondary air supplying passage 11 within the air cleaner 13, and a check valve 14 which closes by a positive pressure and opens by a negative pressure of the exhaust pulsation developed, for example, in the exhaust pipe 4*e*, is provided at an intermediate portion of the supplying passage 11 for supplying the secondary air into the exhaust pipe 4*e*, so that the secondary air necessary for the reaction in the catalysis type purification device 9 can be supplied, without particularly employing a separate air pump or the like.

On the other hand, in the course of the exhaust gas recycling passage 12 in which the exhaust gas deriving port 12*b* is formed at the position B in the first connecting pipe 7 at a downstream of the secondary air supplying port 11*b* (position A), there is provided a control valve 15 which opens the recycling passage 12, for example, when the temperature of water for cooling the engine E has exceeded a predetermined set temperature or performs other known control for the exhaust gas recycling so as to recycle the exhaust gases taken out from the deriving port 12*b* to the intake passage 5 at the upstream of the carburetor throttle valve 6.

It is to be noted here that if the exhaust gas deriving port 12*b* at the position B is provided at the downstream of the secondary air supplying port 11*b* at the position A, the exhaust pulsation in the exhaust pipe 4*e* is subjected to shock absorption to a predetermined degree, and therefore, the exhaust gas is taken out without being much influenced by the exhaust pulsation.

Referring to a graph in FIG. 2, there is shown by a solid line (a) a state of the exhaust pulsation at the position B (i.e., the position of the exhaust gas deriving port 12*b*) when the secondary air supplying port 11*b* is provided at the position A as in the embodiment of FIG. 1, while a dotted line (b) represents the state of the exhaust pulsation when the positions A and B of FIG. 1 are reversed, i.e., when the secondary air supplying port 11*b* is provided at the position B, with the exhaust gas deriving port 12*b* being set at the position A. As is clear from the comparison between the lines (a) and (b), the exhaust pulsation is generally reduced in the former related to the solid line (a). It is to be noted here that the exhaust pulsation at the position B of the embodiment of FIG. 1 represented by the solid line (a) particularly has its amplitudes reduced to a large extent at the negative pressure side, with less reduction of its amplitudes at the positive side. The above fact means that, since the intake of the secondary air at the position A is effected when the exhaust pulsation is of negative pressure, the negative pressure is further reduced by the intake of the secondary air, thus contributing to improvement of an average exhaust pressure at the point B on the whole and making it possible to effect the withdrawal of the exhaust gases at the position B under a high exhaust pressure so as to guarantee a sufficient amount of exhaust gas recirculation.

Referring also to FIGS. 3 to 5, there are shown in FIG. 3 relations, with respect to the engine revolutions respectively, of the exhaust gas recycling ratio ((exhaust gas recycling amount/total intake amount) $\times$ 100) represented by a line (a) and obtained when the secondary air supplying port 11*b* is provided at the position A, with the exhaust gas deriving port 12*b* formed at the position B as in the embodiment of FIG. 1, and the exhaust gas recycling ratio represented by the dotted line (b) and obtained when the secondary air supplying port 11b is provided at the position B, with the exhaust gas deriving port 12b formed at the position A, under engine operating condition of intake negative pressure at −400 mmHg. From the graph of FIG. 3, it is noticed that recycling ratios of high level in the order of 12 to 16% are obtainable in the case of the line (a) according to the embodiment of the present invention.

Accordingly, as is seen from FIG. 4 showing comparison of NOx discharge amounts, when the engine is operated under the same condition as that described with reference to FIG. 3, the NOx discharge amount represented by the line (a) for the embodiment of FIG. 1 shows a marked decrease as compared with the NOx discharge amount in the line (b) related to the setting of the ports 11b and 12b opposite to the embodiment of FIG. 1, thus clearly indicating that the generation of NOx is effectively suppressed under an approximately constant exhaust gas recycling ratio of high level.

Meanwhile, regarding the supplying amount of the secondary air, it is seen, from data of experiments of FIG. 5 carried out by the present inventors under the same engine operating conditions as described above, that in the arrangement of the embodiment of FIG. 1, the ratio of the secondary air supplying amount represented by the line (a) can be maintained at a high level at least twice that of the case opposite to the arrangement of FIG. 1 and represented by the line (b), thus being particularly advantageous for introducing the secondary air by utilizing the exhaust pulsation, while by supplying a large amount of the secondary air through utilization of the pulsation, it becomes possible to absorb shock by the exhaust pulsation at the downstream of the exhaust system.

Referring now to FIG. 6, there is shown a modification of the embodiment of FIG. 1. In this modification, a downstream exhaust gas recycling passage 20 is further added to the arrangement of FIG. 1, with a downstream recycling port 20a of the recycling passage 20 being formed in the intake passage 5 at the downstream of the carburetor throttle valve 6 for recycling thereto the exhaust gases. Since the exhaust gases during recycling are hardly affected by the exhaust pulsation at the downstream of the carburetor throttle valve 6 whereat the intake negative pressure is normally sufficiently large, it is preferable, from the viewpoints of simplification on pipings and of achieving sufficient reduction of NOx by preventing mixing of the secondary air into the recycling exhaust gases, that a downstream exhaust gas deriving port 20b of the downstream exhaust gas recycling passage 20 is provided in one of the exhaust pipes belonging to the second exhaust pipe group G2 different from the first exhaust pipe group G1 which supplies the secondary air, for example, at an intermediate portion of the exhaust pipe 2e as shown for taking out the exhaust gases therefrom. The exhaust gas recycling passage 20 is further equipped with a control valve 21 at an intermediate portion thereof for effecting the exhaust gas recycling in the known manner.

It should be noted here that in the foregoing embodiments of FIGS. 1 and 6, although the upstream recycling exhaust gases are described as derived from the connecting pipe 7 (or connecting pipe 8) through the exhaust gas recycling passage 12 having the exhaust gas deriving port 12b (the position B) opened in the connecting pipe 7 (or 8) for recycling the exhaust gases to the intake passage 5 at the upstream of the carburetor throttle valve 6, the position for taking out the exhaust gases is not limited to be provided in the connecting pipe 7 or 8, but in short, the exhaust gases may be derived from any positions of the exhaust system at the downstream of the secondary air supplying port 11b (the position A) of the secondary air supplying passage 11. More specifically, the exhaust gases may be withdrawn from any positions at the downstream of the position A in the corresponding exhaust pipe group G1 or G2 as well as from the exhaust gas lead-out pipe 10.

It should also be noted that the secondary air may be modified to be supplied by an air pump or the like, but when the exhaust pulsation alone is utilized for the supplying of the secondary air as in the embodiment of FIGS. 1 and 6, the secondary air is mixed into the recycled exhaust gases only when the exhaust pulsation is of negative pressure, and thus the mixing of the secondary air into the recycled exhaust gases is small in the amount as compared with the cae where the air pump is employed, with favorable results in the reduction of NOx.

Referring also to FIG. 7, there is shown another modification of the arrangement of FIG. 1. In this modification, the secondary air supplying passage 11 of FIG. 1 having the check valve 14 and opened at its one end (the air intake port 11a) in the air cleaner 13 and at the other end thereof (the secondary air supplying port 11b) in the exhaust pipe 4e of the first exhaust pipe group G1 is dispensed with, while the exhaust gas deriving port 12b for the exhaust gas recycling passage 12 described as formed at the position B in the first connecting pipe 7 is modified to be formed at a point B′ in the lead-out pipe 10 in a position adjacent to the junction 10a of the first and second connecting pipes 7 and 8, with other arrangement being the same as that in FIG. 1.

The above arrangement of FIG. 7 is particularly intended to make it possible to achieve correct control of the exhaust gas recycling and to obtain a large amount of the recycling exhaust gases by preventing adverse effects due to the exhaust pulsation through formation of the exhaust gas deriving port 12b′ at a portion of the lead-out pipe 10 whereas the exhaust pulsation is weak.

More specifically, in the arrangement of FIG. 7, the amounts of the exhaust gas recycling (EGR) will be considered hereinbelow with respect to cases where the exhaust gas deriving port is provided at a position C of the first exhaust pipe group G1, and at positions D or E of the first connecting pipe 7.

Referring also the graph of FIG. 8 showing $$EGR \text{ ratio } \left(EGR \text{ ratio} = \frac{\text{Amount of } EGR}{\text{Total amount of intake}} \times 100\right)$$

with respect to the engine revolutions in the case where the engine is operated at the intake negative pressure of −400 mmHg, if the exhaust gas deriving port is provided at the position C, or D or E as described above with reference to FIG. 7, the EGR ratio can not be maintained at high levels as is seen from lines having corresponding synbols (C) and (D or E) respectively, with the EGR ratio falling to a large extent at particular engine revolutions, i.g., in the vicinity of 2000 r.p.m. in this graph due to influence of interference by the intake. Although such a sharp falling may be eliminated as shown by a line (D + surge tank) of FIG. 8 by installing a surge tank (not shown) having capacity of approximately 2 l in the exhaust gas recycling passage when the exhaust gas is to be derived from the position D of FIG. 7, the EGR ratio still remains at a low level, thus it being impossible to achieve the necessary EGR ratio.

On the contrary, when the exhaust gas deriving port 12b' is formed at the position B' as in the arrangement of FIG. 7 according to the present invention, not only the EGR ratio can be maintained at a high level in the region of 10 to 11%, but the reduction of the EGR ratio in the vicinity of the engine revolutions of 2000 r.p.m. is advantageously prevented as is noticed from a line (B') of FIG. 8.

Referring to a graph of FIG. 9 showing relation between the positions of the recycling exhaust gas deriving ports and the EGR ratio, it is clearly seen tha the EGR ratio is markedly increased by approximately 2 times, if the exhaust gas deriving port is formed at the position B' in the lead-out pipe 10 as in the embodiment of FIG. 7 when the engine is operated under the conditions of intake negative pressure of −400 mmHg and engine revolutions of 2000 r.p.m., which fact means that the exhaust pulsation is gradually weakened step by step through the first and second exhaust pipe groups G1 and G2 and also the first and second connecting pipes 7 and 8, and is almost perfectly suppressed at the lead-out pipe 10 which combines the first and second connecting pipes 7 and 8, thus making it possible to recycle the exhaust gases under an approximately stable exhaust pressure.

Referring now to FIGS. 10 and 12, there is shown in FIG. 11 a modification of the exhaust gas deriving port 12b or 12b' of FIG. 10 employed in the arrangements of FIGS. 1, 6 and 7. In FIG. 11, the modified gas deriving port 12b'' is provided with a distal portion 12b''a laterally extending from the port 12b'' within the lead-out pipe 10 in a direction confronting the flow of the exhaust gases for receiving the dynamic pressure of the exhaust gases thereat. It is needless to say that such a distal portion 12b''a may be integrally formed with the exhaust gas deriving passage 12 by bending process or the like, or may be separately formed for rigid connection to the passage 12 by suitable means. In this case, it will be noticed from a line Pb in the graph of FIG. 12 that the EGR ratio can be maintained much higher than the EGR ratio of the ordinary deriving port 12b' or 12b of static pressure type represented by a line Pa in which the deriving port is merely opened into the pipe of the exhaust system as in FIG. 10.

Referring to FIG. 13, there is shown a further modification of the arrangement of FIG. 6. In the modification of FIG. 13, the downstream exhaust gas recycling passage 20 for the exhaust gas recycling at the downstream of the throttle valve 6 is so modified as to have its exhaust gas deriving port 20b formed in an intermediate portion of the exhaust pipe 1e which belongs to the first exhaust pipe group G1, while the secondary air supplying port 11b' of the secondary air supplying passage 11 is also modified to be formed at an intermediate portion of the exhaust pipe 3e of the second exhaust pipe group G2, and the exhaust gas recycling passage 12 has its exhaust gas deriving port 12b'' with the distal portion 12b''a (FIG. 11) formed in the lead-out pipe 10 to receive the dynamic pressure of the exhaust gas as described with reference to FIG. 11.

Referring also to FIG. 14 showing another modification of the arrangement of FIG. 13, the secondary air supplying passage 11 described as having its secondary air supplying port 11b' formed at the intermediate portion of the exhaust pipe 3e is further modified to have its secondary air supplying port 11b'' formed at a lower portion or a portion adjacent to a junction J of the exhaust pipes 2e and 3e belonging to the second group G2 and the second connecting pipe 8, while the exhaust gas deriving port 12b'' (FIG. 11) described as employed in the arrangement of FIG. 13 is replaced by the ordinary deriving port 12b' (FIG. 10).

Since other constructions and functions of the modifications of FIGS. 13 and 14 are similar to those of FIG. 6, detailed description thereof is abbreviated for brevity.

In the arrangements of the modifications of FIGS. 13 and 14 also, difference of the exhaust characteristics of each position of the dual exhaust system can be effectively utilized so that the secondary air is taken in at the portion whereat the exhaust pulsation is sufficiently strong, while the exhaust gases for recycling to the upstream of the throttle valve can be derived from the portion at which the exhaust pulsation is weakened. Meanwhile, since the position for deriving the recycling exhaust gases for the downstream of the throttle valve is separated through the connecting pipe from the position for supplying the secondary air, mixing of the secondary air into the exhausted gases to be recycled to the downstream of the throttle valve is prevented, while the secondary air can be supplied without employment of the expensive air pump.

As is clear from the foregoing description, according to the exhaust gase purification system of the present invention, in the internal combustion engine equipped with the dual exhaust system, the secondary air supplying port for the secondary air supplying passage is opened into either one of the first or second exhaust pipe group of the dual exhaust system, while the exhaust gas deriving port of the exhaust gas recycling passage for recycling the exhaust gases to the intake passage at the upstream of the carburetor throttle valve is provided in the exhaust line at the downstream of said secondary air supplying port. In the manner as described above, the dual exhaust system is effectively combined with the throttle valve upstream exhaust gas recycling, and while improvement of the engine output is aimed at by the dual exhaust system, the exhaust gases are derived at an approximately constant rate for the portion whereat the exhaust pulsation is most weakened by the dual exhaust system for recycling the exhaust gases to the intake passage at the upstream of the carburetor throttle valve, thus not only the correct exhaust gas recycling control being effected, but the undesirable NOx being drastically suppressed by the large amount of EGR gases. In other words, according to the exhaust gas purification system of the invention, the necessary secondary air is introduced, with the engine output advantageously maintained by the adoption of the dual exhaust system, and furthermore, by the introduction of the secondary air, the shock by the exhaust pulsation is absorbed so that the exhaust gases are recycled to the upstream of the carburetor throttle valve without influence by the exhaust pulsation, thus the NOx being effectively suppressed, while the exhaust gas recycling ratio is maintained at the high level, with simultaneous accurate control of the exhaust gas recycling amount.

Although the present invention has been fully described by way of example with reference to the accompanying drawings, it is to be noted that various changes and modifications are apparent to those skilled in the art. For example, the exhaust gas deriving ports 12b and 12b' of the ordinary configuration (FIG. 10) described as employed in the arrangements of FIGS. 1, 6, 7 and 14 may be replaced by the modified exhaust gas deriving port 12b'' (FIG. 11) as adopted in the arrangement of FIG. 13 depending on the necessity. Therefore, unless otherwise such changes and modifications depart from the scope of the present invention, they should be construed as included therein.

What is claimed is:

1. In an internal combustion engine having an exhaust system which includes first and second exhaust pipe groups each formed by collecting, at one junction, exhaust pipes for cylinders whose ignition sequences are not continuous, of the exhaust pipes respectively connected to a plurality of cylinders, a first connecting pipe having its one end connected to said first exhaust pipe group, a second connecting pipe having its one end connected to said second exhaust pipe group, said first and second connecting pipes being collected to communicate with each other at the other ends thereof, and a lead-out pipe having its one end connected to said collected other ends of said first and second connecting pipes and having its other end opened into atmosphere, an exhaust gas purification system for use in said internal combustion engine which comprises a secondary air supplying port formed at one end of a secondary air supplying passage and opened into one exhaust pipe group selected from said first and second exhaust pipe groups, and an upstream exhaust gas recycling passage having its upstream exhaust gas deriving port so provided as to derive exhaust gases from an exhaust line at downstream of a position of said secondary air supplying port for introducing the exhaust gases to an intake passage at an upstream of a carburetor throttle valve of said internal combustion engine.

2. An exhaust gas purification system as claimed in claim 1, wherein said upstream exhaust gas recycling passage has said upstream exhaust gas deriving port thereof opened into one connecting pipe connected to said one exhaust pipe group into which the secondary air supplying port is opened.

3. An exhaust gas purification system as claimed in claim 1, wherein said upstream exhaust gas recycling passage has said upstream exhaust gas deriving port thereof opened into said lead-out pipe.

4. An exhaust gas purification system as claimed in claim 1, wherein said secondary air supplying port is opened into the one exhaust pipe group selected from said first and second exhaust pipe groups, with a downstream exhaust gas deriving port of a downstream exhaust gas recycling passage being further opened in the other exhaust pipe group of said first and second exhaust pipe groups for introducing the exhaust gases to the intake passage at a downstream of the carburetor throttle valve of said internal combustion engine.

5. An exhaust gase purification system as claimed in claim 1, wherein said secondary air supplying passage has its other end opened into atmosphere through check valve means.

6. An exhaust gas purification system as claimed in claim 1, wherein said secondary air supplying port of said secondary air supplying passage is opened into said one junction of the exhaust pipes of the exhaust pipe group selected from said first and second exhaust pipe groups.

7. An exhaust gas purification system as claimed in claim 1, wherein said upstream exhaust gas deriving port of said upstream exhaust gas recycling passage is so directed as to receive dynamic pressure of the exhaust gases.

8. In an internal combustion engine having an exhaust system which includes first and second exhaust pipe groups each formed by collecting, at one junction, exhaust pipes for cylinders whose ignition sequences are not continuous, at the exhaust pipes respectively connected to a plurality of cylinders, a first connecting pipe having its one end connected to said first exhaust pipe group, a second connecting pipe having its one end connected to said second exhaust pipe group, said first and second connecting pipes being collected to communicate with each other at the other ends thereof, and a lead-out pipe having its one end connected to said collected other ends of said first and second connecting pipes and having its other end opened into atmosphere, an exhaust gas purification system for use in said internal combustion engine which comprises a secondary air supplying passage having at one end thereof a secondary air supplying port opened into an intermediate portion of one of the exhaust pipes which belongs to said first exhaust pipe group and at the other end thereof opened into atmosphere, said secondary air supplying passage being provided with a check valve which is selectively closed by positive pressure and opened by negative pressure of exhaust pulsation developed in said one of the exhaust pipes, an upstream exhaust gas recycling passage provided with an exhaust gas recycling control valve and having at one end thereof an upstream exhaust gas deriving port opened into an intermediate portion of said first connecting pipe and at the other end thereof an upstream exhaust gas recycling port opened into an upstream of a carburetor throttle valve of said internal combustion engine, and a downstream exhaust gas recyling passage provided with another exhaust gas recycling control valve and having at one end thereof a downstream exhaust gas deriving port opened into an intermediate portion of one of the exhaust pipes which belongs to said second exhaust pipe group and at the other end thereof a downstream exhaust gas recycling port opened into a downstream of said carburetor throttle valve.

9. In an internal combustion engine having an exhaust system which includes first and second exhaust pipe groups each formed by collecting, at one junction, exhaust pipes for cylinders whose ignition sequences are not continous, of the exhaust pipes respectively connected to a plurality of cylinders, a first connecting pipe having its one end connected to said first exhaust pipe group, a second connecting pipe having its one end connected to said second exhaust pipe group, said first and second connecting pipes being collected to communicate with each other at the other ends thereof, and a lead-out pipe having its one end connected to said collected other ends of said first and second connecting pipes and having its other end opened into atmosphere, an exhaust gas purification system for use in said internal combustion engine which comprises a secondary air suppplying passage having at one end thereof a secondary air supplying port opened into an intermediate portion of one of the exhaust pipes which belongs to said second exhaust pipe group and at the other end thereof opened into atmosphere, said secondary air supplying passage being provided with a check valve which is selectively closed by positive pressure and opened by negative pressure of exhaust pulsation developed in said one of the exhaust pipes, an upstream exhaust gas recycling passage provided with an exhaust gas recycling control valve and having at one end thereof an upstream exhaust gas deriving port opened into said lead-out pipe and at the other end thereof an upstream exhaust gas recycling port opened into an upstream of a carburetor throttle valve of said internal combustion engine, and a downstream exhaust gas recycling passage provided with another exhaust gas recycling control valve and having at one end thereof a downstream exhaust gas deriving port opened into an intermediate portion of one of the exhaust pipes which belongs to said first exhaust pipe group and at the other end thereof a downstream exhaust gas recycling port opened into a downstream of said carburetor throttle valve.

10. An exhaust gas purification system as claimed in claim 9, wherein said upstream exhaust gas deriving port is so directed in said lead-out pipe as to receive dynamic pressure of the exhaust gases.

11. In an internal combustion engine having an exhaust system which includes first and second exhaust pipe groups each formed by collecting, at one junction, exhaust pipes for cylinders whose ignition sequences are not continous, of the exhaust pipes respectively connected to a plurality of cylinders, a first connecting pipe having its one end connected to said first exhaust pipe group, a second connecting pipe having its one end connected to said second exhaust pipe group, said first and second connecting pipes being collected to communicate with each other at the other ends thereof, and a lead-out pipe having its one end connected to said collected other ends of said first and second connecting pipes and having its other end opened into atmosphere, an exhaust gas purification system for use in said internal combustion engine which comprises a secondary air supplying passage having at one end thereof a secondary air supplying port opened into a position adjacent to a junction of the exhaust pipes which belong to said second exhaust pipe group and said second connecting pipe and at the other end thereof opened into atmosphere, said secondary air supplying passage being provided with a check valve which is selectively closed by positive pressure and opened by negative pressure of exhaust pulsation developed in said one of the exhaust pipes, an upstream exhaust gas recycling passage provided with an exhaust gas recycling control valve and having at one end thereof an upstream exhaust gas deriving port opened into said lead-out pipe and at the other end thereof an upstream exhaust gas recycling port opened into an upstream of a carburetor throttle valve of said internal combustion engine, and a downstream exhaust gas recycling passage provided with another exhaust gas recycling control valve and having at one end thereof a downstream exhaust gas deriving port opened into an intermediate portion of one of the exhaust pipes which belong to said first exhaust pipe group and at the other end thereof a downstream gas recycling port opened into a downstream of said carburetor throttle valve.

* * * * *